United States Patent [19]

Weber

[11] 4,085,985

[45] Apr. 25, 1978

[54] CENTRAL LOCKING MECHANISM

[75] Inventor: Michael Weber, Gaildorf-Unterrot, Germany

[73] Assignee: Wilhelm Bott KG, Gaildorf, Germany

[21] Appl. No.: 730,473

[22] Filed: Oct. 7, 1976

[51] Int. Cl.[2] ..... E05B 65/46

[52] U.S. Cl. ..... 312/216; 312/218; 312/221

[58] Field of Search ..... 312/216, 218, 221, 107.5

[56] References Cited

U.S. PATENT DOCUMENTS

| | | | |
|---|---|---|---|
| 1,063,844 | 6/1913 | Swanson | 312/221 |
| 1,370,089 | 3/1921 | Chipperfield | 312/218 |
| 2,810,616 | 10/1957 | McClellan | 312/218 |
| 2,829,021 | 4/1958 | Wolters | 312/218 |
| 2,908,538 | 10/1959 | Stegmaier | 312/218 |
| 2,992,056 | 7/1961 | Thielker | 312/221 |
| 3,284,149 | 11/1966 | Lewin | 312/218 |
| 3,371,974 | 3/1968 | Vermeersch | 312/218 |
| 3,799,638 | 3/1974 | Faiks | 312/216 |
| 3,883,200 | 5/1975 | Latham | 312/216 |
| 3,965,707 | 6/1976 | Byars et al. | 312/216 |

FOREIGN PATENT DOCUMENTS

| | | | |
|---|---|---|---|
| 142,633 | 2/1948 | Australia | 312/218 |
| 1,553,575 | 6/1969 | Germany | 312/216 |
| 847,221 | 9/1960 | United Kingdom | 312/221 |

*Primary Examiner*—Paul R. Gilliam
*Assistant Examiner*—Victor N. Sakran

[57] ABSTRACT

In the locked position of the central locking mechanism the locking bolt can be elastically displaced when a still opened drawer is being closed. In the unlocked position of the central locking mechanism, the locking bolt is swivelled into the blocking position when a drawer is being opened and swivelled back into the release position when the drawer is being closed.

8 Claims, 3 Drawing Figures

CENTRAL LOCKING MECHANISM

The present invention relates to a central locking mechanism for an item of furniture with a plurality of drawers arranged in a series side by side or one above the other, each of said drawers having an integral blocking projection which is arranged transversally to the sliding direction of the drawer and having a locking bolt which extends beyond all drawers which can be swivelled about a stationary axis into the motion path of the blocking projections, said stationary axis running parallel to the longitudinal axis of the locking bolt so that closed drawers cannot be opened. In the locked position of the central locking mechanism the locking bolt can be swivelled against the force of a spring out of the blocked position when an opened drawer is being closed. A device of this type is known from the German patent specification laid open for public inspection 1,553,575. In this known device several drawers may be open at the same time so that there is the risk that the item of furniture falls over. The invention is based on the technical problem to design a central locking mechanism in such a manner so that in the case of normal operation of the item of furniture only one single drawer can be opened respectively. According to the invention this object is achieved by connecting the locking bolt to a lever arm, which, in the unlocked position of the locking bolt, projects into the path of a stopping face which is arranged on each drawer in such a manner that the stopping face butts against the lever arm when a drawer is being opened and that the locking bolt swivels into the locking position.

Admittedly, the features according to the invention which have just been mentioned are already known as such from the German utility model 7,331,161 in a cabinet with a plurality of drawers of which only one drawer can respectively be opened; however, in the known cabinet it is not possible to close opened drawers in the locked position of the central locking mechanism. In particular, the known cabinet is not characterized by the feature that in the locking position of the central locking mechanism, the locking bolt can be swivelled out from the locking position against the force of a spring when an opened drawer is being closed. The stopping face may be arranged in any desired manner, however, in one embodiment of the invention the stopping face is a face of the blocking projection which faces in the direction of opening. In this connection it is advantageous that the arrangement may be of a very simple and low-cost construction, for example, no complicated design is required for the stopping face and the locking bolt as well as the lever arm connected therewith may be of a simple construction, for example, these interconnected parts may be formed by the two legs of an angle section which has been manufactured by bending a metal sheet or by welding two flat metal strips together.

In one embodiment of the invention an indexed position is provided for the locking position of the locking bolt when the central locking mechanism is unlocked. This has the advantage that the locking bolt cannot inadvertently leave the locking position, for example as a result of vibrations of the cabinet. In a further development of the invention an indexed position is also provided for the unlocking position of the locking bolt when the central locking mechanism is being unlocked. This has also the aforementioned advantage.

In one embodiment of the invention a tilting member is provided which respectively tends to hold the locking bolt in one of two stable positions relative to the part driving the locked bolt. In this case the advantage consists in that the part driving the locking bolt is not required to move the locking bolt completely into its respective end position but it is sufficient if the part driving the locking bolt only moves the locking bolt beyond the position of unstable equilibrium which is located between the two stable positions; subsequently, the locking bolt automatically moves into the other end position.

In one embodiment of the invention the actuationg member of the central locking mechanism is elastically coupled with the locking bolt and a stop cooperating with the locking bolt is provided, said stop, when locking the central locking mechanism, preventing a swivel motion in the locking direction of the locking bolt which is in the locking position, with the central locking mechanism being unlocked so that, during the blocking of the central locking mechanism, the locking bolt leaves the indexed position which is provided for the locking position when the central locking mechanism is unlocked. This has the advantage that, after the locking and subsequent unlocking of the central locking mechanism, the locking bolt is in any case in the unlocking position, irrespective of the fact in which position it has been for the locking of the central locking mechanism. After the opening of a drawer by locking and subsequently unlocking of the central locking mechanism this offers the possibility to open a further drawer which may, for example, be useful for maintenance purposes. The abuse of this possibility can easily be prevented if the key which is required for the unlocking of the central locking mechanism is not kept in close vicinity of the item of furniture. In most cases, the lock for locking the central locking mechanism is designed as a push-button lock in the push-button of which a locking cylinder is installed so that in any case it is expedient to withdraw the key after the unlocking of the central locking mechanism because only with the key being withdrawn the push-button of the lock can be depressed in a simple manner by finger pressure and the lock be thereby locked. The "locking direction" is defined as the direction of the swivel motion of the locking bolt which the locking bolt would perform when locking the central locking mechanism if the aforementioned stop would not exist.

In one embodiment of the invention a plate is arranged to swivel about a swivel axis of the locking bolt, a part being coupled with the actuating member of the central locking mechanism acting on the plate in such a manner that the plate is swivelled upon actuation and the tilting member connecting the plate to the locking bolt is arranged on the plate. This embodiment is characterized by great simplicity of the necessary individual parts which all can be manufactured without great expenditure. Any arrangement which ensures that the locking bolt can move to two stable positions only relative to the plate is suitable as tilting member.

In one embodiment of the invention the tilting member is provided with a two-armed lever which is arranged to swivel on the plate; one arm of the lever is provided with an elongated hole extending into the longitudinal direction of the lever in which a pin being connected with the locking bolt engages, said pin being located nearer to the swivel axis of the locking bolt than the swivel axis of the lever, and the other arm of the lever is connected to the swivel axis of the locking lever via a tension spring. The advantage of this embodiment consists in the very simple design of the tilting member. The tilting member described can easily be modified, for example, by using a compression spring instead of the tension spring, which in this case acts for example on the other arm of the lever. The actuating member of the central locking mechanism can be connected to the plate in such a manner that, both during the locking of the central locking mechanism and during the unlocking, the movement of the actuating member is transmitted to the plate by the interposition of (an) elastic parts, for example springs. However, in one embodiment of the invention that spring, against the force of which - with the central locking mechanism being locked - the locking bolt can be swivelled out of the locking position when closing a drawer, is interposed in such a manner between the plate and a part being kinematically coupled with the actuating member of the central locking mechanism that the spring tends to keep one face of the plate continuously in frictional connection with one face of the aforementioned part. The advantage of this arrangement consists in that only one spring is required to produce the necessary elasticity between the actuating member of the central locking mechanism and the locking bolt. In one embodiment of the invention the plate is provided with an elongated hole; in the elongated hole a bolt, rigidly connected with a rod which is pivoted to the actuating member, is guided, and the spring tends to keep one end of the elongated hole in contact with the bolt. This embodiment offers the advantage to connect the plate to the actuating member in a simple manner so that there is sufficient play.

Further features and advantages of the invention will become apparent from the following description of one embodiment of the invention on the basis of the drawings which show details that are essential for the invention and from the claims. The individual features may be applied either individually or in any desired combination of a plurality of such features. In the drawins FIG. 1 is a partially broken top view of a device according to the invention which is installed into a cabinet with a plurality of drawers being arranged one above the other;

Figure 1:
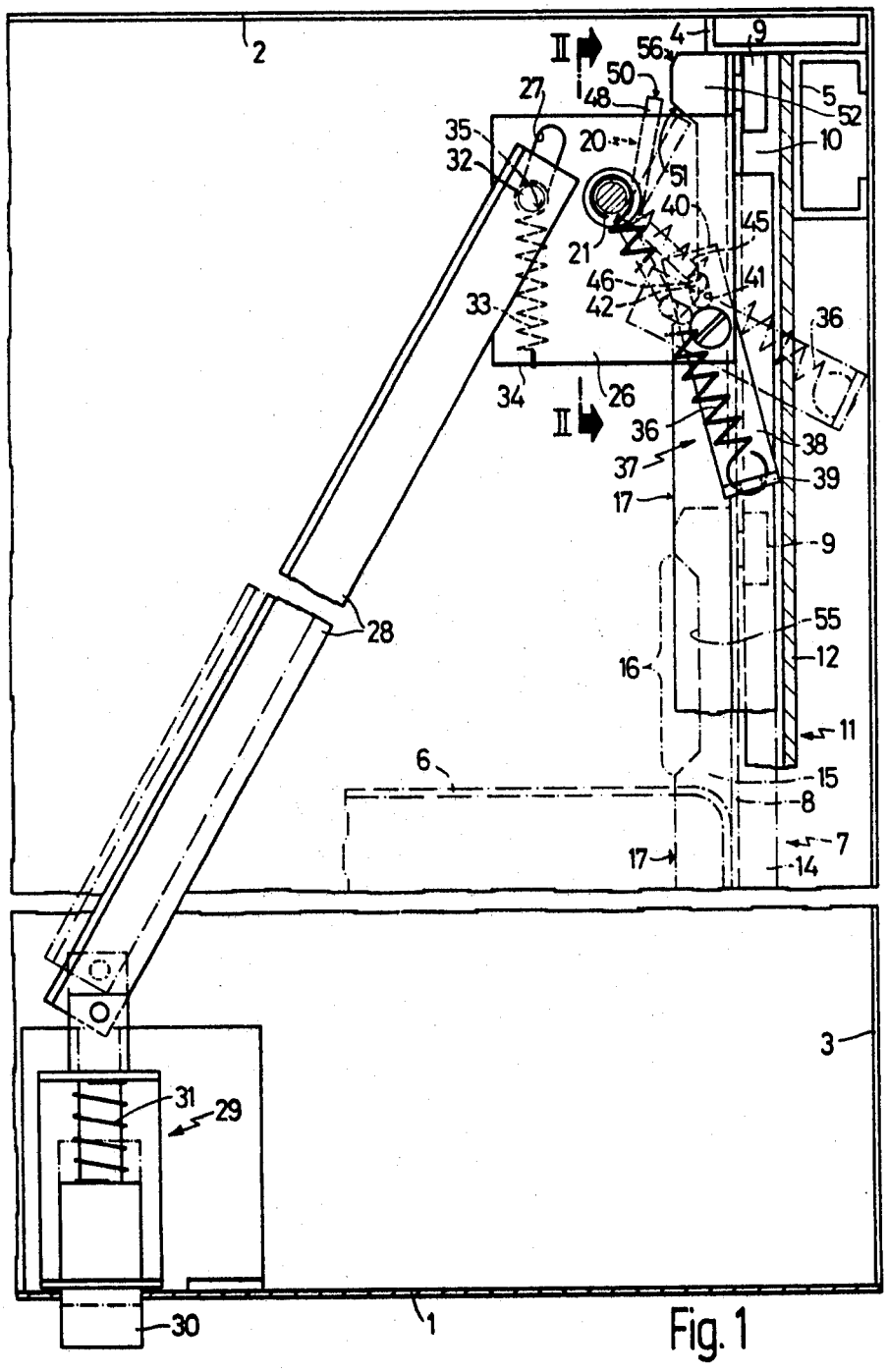

FIG. 1 shows some parts only of a cabinet in which the device according to the invention is installed. A portion of the front wall 1 of the metal cabinet as well as the RH rear corner with the rear wall 2 and the RH side wall 3 are represented. Rear wall 2 and side wall 3 are interconnected by metal section 4 and 5. Out of the plurality of the drawers, arranged one above the other, only the RH rear corner of a drawer 6 is represented by chain-dotted lines in a partially opened position. The drawer is connected to a Z-section 7 from metal which rearwardly projects over the rear wall of the drawer. FIG. 1 also shows a Z-section 7 in the position when the drawer is fully closed. At the rear end portion of the vertical web 8 of the Z-section 7 a roller 9 with a horizontal rotation axis is arranged by means of which the drawer 6 can be moved forward and backward on the surface of the lower leg 10 of U-rail 11 from metal with a vertical yoke 12. In a manner not represented in the drawing, near the front wall of the cabinet, a roller is arranged in the U-rail 11 to swivel about a stationary axis, the drawer with the upper horizontal leg 14 of Z-section 7 resting on said roller. Thus, the drawer 6 is guided on rollers in the cabinet. Near its rear end the lower horizontal leg 15 of Z-section 7 is provided with an open recess 16 by means of which the drawers can be blocked in the closed position. The recess 16 is trapezoidal, the base lines of the trapezium run in the sliding direction of the drawers, the imaginary longer base line of the trapezium being in alignment with the LH edge 17 of the lower leg 15 (cf. FIG. 1). The LH side of the cabinet which is not represented in FIG. 1 is designed in the same manner as described above, with the exception that there is no recess 16. A metal angle section 20 with a vertical vertex line is disposed in the cabinet in such a manner that it can be swivelled into the positions represented by solid and chain-dotted lines. For this purpose, in the upper end portion of the angle section 20, near the outer vertex line, a pivot pin 21 is attached by welding which is swivably supported by a stirrup 23 which is secured to the cabinet in a manner not represented and which is provided with a hole 22. At its lower end the angle section 20 is swivably supported in a similar manner.

The pivot pin 21 carries a square plate 26 which cannot be axially displaced but swivelled, said plate having an elongated hole 27 on the side of its swivel axis facing away from the recess 16. A push-rod 28 which is formed of an angle-shaped metal sheet for stiffening is pivotally connected to a push-button lock 29 with one end, which is secured to the front wall 1 above the drawers. When upwardly pressing the push-button 30, represented in FIG. 1, by finger pressure it engages in the depressed final position and disengages only if the push-button lock is actuated by a key; in this case the push-button 30 is returned to its outer end position by a spring 31. In FIG. 1 the end position is represented by solid lines. In this position the drawers are released. The positions of the plate 26 and the push-rod 28, with the push-button lock 29 being unlocked, are represented by solid lines; the position of the push-rod 28, with the push-button lock 29 being pushed home (locked) is partially represented by chain-dotted lines; this also applies to the push-button lock itself. In its rear end portion the push-rod 28 is provided with a downwardly projecting bolt 32 which engages in the elongated hole 27 and which is secured against being lifted out of the elongated hole 27 by means not represented in the drawing, for example by a snap ring or cotter pin. Thus, the push-rod 28 is also secured in its approximately horizontal position above the drawers. The bolt 32 can be displaced in the elongated hole 27 which extends approximately in the longitudinal direction of the push-rod 28. In the representation shown in FIG. 1, a spring 33 which is designed as tension spring and the one end of which acts on the edge 34 of plate 26 facing the front wall 1 and the other end of which acts of the bolt 32, retains the end 35 of the elongated hole 27 facing the front wall 1 in close fit to the bolt 32. Upon depressing of the push-button 30 the bolt 32 is also displaced together with the push-rod 28 towards the rear wall 2 of the cabinet and tends to turn the plate 26, via spring 33, in the clockwise direction, as shown in FIG. 1.

In the vicinity of the RH forward edge of plate 26 a two-armed lever 37 is swivably arranged on the underside of said plate. The end of the longer arm 38 of the lever facing the RH side wall 3 is bent upwardly and a tension spring 36 is hooked with one end to the upwardly bent portion 39, the other end of the tension spring acting on the pivot pin 21. The shorter arm 40 of the lever 37 is provided with an elongated hole 41 which extends in the longitudinal direction of the lever, a vertically arranged pin 42 engaging said elongated hole from below. The pin 42 is welded to the shorter leg 45 of the angle section 20. The angle section itself does not extend up to the height at which the lever 37 is located. The tension spring 36 tends to move the upwardly bent portion 39 as close as possible to the pivot pin 21; this motion is limited due to the fact that the pin 42 bears against the end 46 of the elongated hole 41 which faces away from the swivel axis of lever 37. The lever 37 shown in the arrangement in FIG. 1. can therefore only swivel forward and backward within an angular range of approximately 45°; the two stable end positions are represented by solid and chain-dotted lines. As far as the spring 36 is concerned, the intermediate positions of lever 37 are unstable. The longer leg of the angle section 20 constitutes the locking bolt 48 of the arrangement. The locking bolt 48, together with the shorter leg 45, forms an obtuse angle. When the lever 37 is in the position represented by solid lines, the locking bolt 48 is also in the position represented by solid lines and its front face, in this case, is located at a lateral distance from a stopping face 51 on a blocking projection 52. The blocking projection 52 is formed by a rear end portion of the lower leg 15 of Z-section 7, the stopping face 51 separating the blocking projection 52 from the recess 16. In the described position of the locking bolt 48 the drawers are released. If one of the completely closed drawers is drawn forwardly, its stopping face 51 butts against the shorter leg 45 of the angle section 20 the end portion of which is located within the recess 16. If the drawer is further opened the shorter leg 45 is swivelled clockwise by the stopping face 51 represented in FIG. 1 until the lever 37 has past the position of the unstable equilibrium. Subsequently, the lever 37 snaps into the position represented in FIG. 1 by chain-dotted lines and the swivel motion of the angle section 20 follows this movement of lever 37. The locking lever therefore moves into the position represented by chain-dotted lines and its front face 50 is now located opposite the stopping face 51 of the drawer which has not yet been opened; no further drawers can therefore be opened. If the opened drawer is closed again, the canted edge 56 from the front butts against the locking bolt 48 which is in the locking position whereby the latter — as shown in FIG. 1 — is swivelled anticlockwise until the lever 37 snaps back into the position which is represented by solid lines and the locking bolt 48 also returns to the position which is represented by solid lines. Now, one of the drawers can be opened again.

If the push-button 30 is subsequently depressed in the moment when the locking bolt 48 is in the release position, in order to lock the push-button lock 29, the plate 26 — as shown in FIG. 1 — performs a clockwise swivel motion about the pivot pin 21. This swivel motion of plate 26 is finished in the moment when the push-button 30 and consequently also the push-rod 28 are no longer moved or when any part of the angle section 20 bears against the stop which impedes a clockwise swivel motion of angle section 20. This also blocks a further clockwise swivel motion of plate 26 because, due to the bearing of the pin 42 against the end 46 of the elongated hole 41 facing the pivot pin 21, with the angle section 20 being held in place, a further clockwise swivel motion of plate 26 relative to the angle section 20 is no longer possible. For this reason, if the clockwise rotational motion of plate 26 is blocked in the manner described the spring 33 expands in the moment when the push-button 30 is still further depressed. In the embodiment represented the face 55 corresponding to the shorter base line of the recess 16 constitutes such a stop for the end of the locking bolt 48.

If the push-button 30 is fully depressed and the push-button lock 29 consequently locked, plate 26 is slightly rotated clockwise as compared to the position shown in FIG. 1 and the front face 50 of the locking bolt 48 prevents the opening of closed drawers. Nevertheless, the drawer 6 which is still opened when locking the lock 29 can still be closed. In this case, the canted edge 56 of the blocking projection 52 butts against the face of the locking bolt 48 facing the front wall 1 and thereby swivels the locking bolt 48 together with plate 26 sufficiently anticlockwise that the blocking projection 52 is able to slide past the locking bolt 48, while the spring 33 is simultaneously expanding. Once the blocking projection 52 has passed the locking bolt 48, the plate 26, together with the locking bolt 48, is again rotated clockwise by the spring 33 so that the drawers are locked again.

If the angle section 20, with the push-button lock 29 being unlocked, is in the locking position, i. e. in the position shown by chain-dotted lines and if now the push-button 30 is depressed, first the plate 26 is also swivelled clockwise until the locking bolt 48 bears against face 55. In relation to tension spring 36 spring 33 is designed so that, upon further depressing of push-button 30, the plate 26 is further rotated. During this rotation the angle section 20 performs an anticlockwise movement relative to the plate 26 until the lever 37 swivels round into the position represented by solid lines. Now, the push-button is partially depressed and the angle section 20, relative to the already partially swivelled plate 26, moves into the position which is represented by solid lines. If the push-button 30 is now further depressed the plate 26, together with the angle section 20, continues to perform a clockwise rotation, until — as explained above — the locking bolt 48 bears against face 55 or until the push-button lock 29 has already previously attained its locking position. If the push-button lock 29 is subsequently unlocked again the locking bolt 48 is in the release position. Irrespective of the fact whether the locking bolt 48 has been in the locking or release position prior to the blocking of the push-button lock 29, after the unlocking of the push-button lock 29 the locking bolt 48 consequently moves into its release position.

The tilting member which consists of the lever 37, the tension spring 36 and the pin 42 engaging in the elongated hole 41 can also be constructed in a different manner, for example, the tension spring 36 and the longer arm 38 can be replaced by a compression spring which is inserted between the pivot pin 21 and the end of the shorter arm 40 of the lever.

Figure 2:
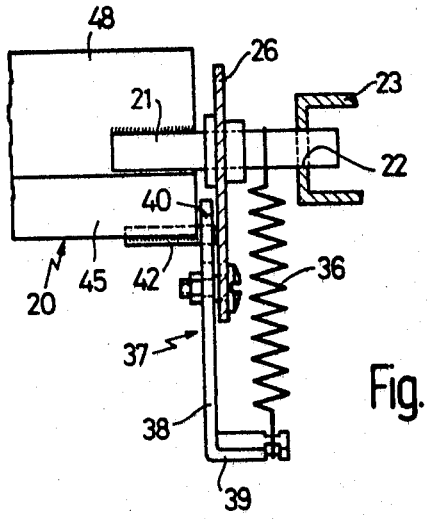
FIG. 2 is partial section taken along the line II—II in FIG. 1.
Figure 3:
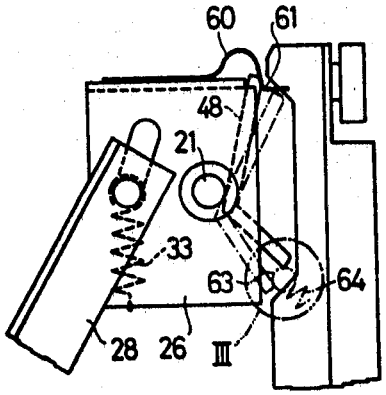
FIG. 3 shows two alternative designs of the tilting member represented in FIGS. 1 and 2.

FIG. 3 shows two alternative designs of the tilting member represented in FIGS. 1 and 2 which essentially comprises the lever 37 and the tension spring 36. In the arrangement shown in FIG. 3 the portion of plate 26 facing the rear wall of the cabinet is downwardly bent, and to the surface of this bent over portion facing the rear wall a leaf spring 60 is secured which has the bent shape shown in FIG. 3. A curved section 61 is in engagement with the end section of the locking bolt 48 facing the cabinet rear wall and, with the portion of maximum bend, is located at a point between the two end positions (locking position and unlocking position) of the locking bolt to which the latter is able to move when the central locking mechanism is unlocked. If the locking bolt 48 is swivelled relative to plate 26 the end section of locking bolt 48 facing the cabinet rear wall exerts a pressure on the curved section 61 of leaf spring 60 so that the leaf spring 60 is elastically deformed in the direction towards the cabinet rear wall. If the locking bolt is in the center position between its two possible end positions, the leaf spring 60 is bent back to a maximum extent. If the locking bolt is swivelled to its other end position the leaf spring is again approximately in the position shown in FIG. 3 and prevents an unintentional swivelling back of the locking bolt 48. The leaf spring 60 may also be arranged on the plate 26 in such a manner that it engages with the free ends of the shorter leg 45 of the angle section 20.

Instead of the leaf spring 60, the arrangement represented in FIG. 3 in a circle III may also be provided. In this case, a ball 63 is provided which is loaded by a compression spring 64 designed as a helical spring. The ball 63 engages the end of the shorter leg 45 of the angle section 20 in a similar way as described above in the case of the leaf spring 60. The end of the compression spring 64 facing away from the ball 63 is retained on the plate 26 in a manner which is not shown in the drawing and the ball is retained in a guide (not represented) so that it can be displaced in the direction of the axis of the compression spring 64. Consequently, in this arrangement the ball engages the shorter leg 45 like a pawl and is displaced from the position represented in FIG. 3 against the force of the compression spring 64 if the shorter leg 45 is swivelled over from one of the two end positions shown in FIG. 3 into the other end position. Other embodiments of the pawl-like portion of the tilting member are also possible.

Having thus fully described my invention, what I claim as new and wish to secure by Letters Patent is:

1. A central locking mechanism for an item of furniture having a plurality of drawers arranged side by side or one above the other comprising a blocking projection integral with each of said drawers and arranged transversely to the sliding direction of the respective drawer, a locking bolt extending beyond all of said drawers pivotable about a stationary axis into the path of movement of the blocking projections, said stationary axis extending parallel to the longitudinal axis of the locking bolt so that the closed drawers cannot be opened and said locking bolt, in the locked position of the central locking mechanism, being pivotable against the force of a spring out of the blocked position when an opened drawer is being closed, a driving member, a bistable member coupling said driving member and said locking bolt said locking bolt being connected to a lever arm which, in the unlocking position of the locking bolt, projects into the path of a stopping face on each said blocking projection so that the stopping face is engageable with the lever arm when opening a drawer and the locking bolt is pivotable into the locking position.

2. A locking mechanism according to claim 1, in which the stopping face is a face of the blocking projection facing in the opening direction.

3. A locking mechanism according to claim 1, including an actuating member resiliently coupled with the locking bolt, a stop element being provided cooperable with the locking bolt, said stop element, when locking the central locking mechanism, preventing pivotal movement in the blocking direction of the locking bolt which is in the locking position when the central locking mechanism is being unlocked, so that, during the locking of the central locking mechanism, the locking bolt leaves an indexed position which is provided for the locking position in the unlocked condition of the central locking mechanism.

4. A locking mechanism according to claims 3, wherein said driving member comprises a plate arranged to swivel about the swivel axis of the locking bolt, a coupling member coupled with the actuating member and operably connected with the plate in such a manner that the plate is pivoted during the actuation of said actuating member, said driving member comprising a tilting member arranged on the plate, said tilting member connecting the plate with the locking bolt.

5. A locking mechanism according to claim 4, wherein the tilting member comprises a two-armed lever which is hinged on said plate, an arm of the lever having an elongated hole formed therein extending in the longitudinal direction of the lever, a pin member being connected with the locking bolt slidable within said elongated hole, said pin member being located closer to the swivel axis of the locking bolt than the swivel axis of the lever, and the other arm of the lever being connected with the swivel axle of the locking bolt by means of a spring.

6. A locking mechanism according to claims 4, wherein the tilting member is provided with a leaf spring which is in engagement with the locking bolt like a pawl, said leaf spring being located between the locking and unlocking end positions of the locking bolt that are possible in the unlocked condition of the central locking mechanism, said leaf spring being displaceable against the spring load when the locking bolt changes its position.

7. A locking mechanism according to claim 4 including a spring interposed between said plate and said coupling member which is kinematically coupled with said actuating member of the central locking mechanism so that said spring tends to keep a face of the plate continuously in frictional connection with a surface of said bolt element.

8. A locking mechanism according to claim 7, wherein said plate is provided with an elongated hole, said coupling member being a bolt which is dimensioned to be guided in the elongated hole, said bolt element being rigidly connected with a push rod, said push rod being pivotably connected to said actuating member, and said spring being interposed between said plate and said bolt element in such a manner that it tends to keep one end of the elongated hold in contact with the bolt element.

* * * * *